US008727899B1

(12) United States Patent
Galloway

(10) Patent No.: US 8,727,899 B1
(45) Date of Patent: May 20, 2014

(54) ADJUSTABLE GOLF CLUB HOSEL ASSEMBLY

(75) Inventors: J. Andrew Galloway, Escondido, CA (US); Yvonne Galloway, legal representative, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 179 days.

(21) Appl. No.: 13/417,729

(22) Filed: Mar. 12, 2012

Related U.S. Application Data

(60) Provisional application No. 61/470,407, filed on Mar. 31, 2011, provisional application No. 61/481,080, filed on Apr. 29, 2011.

(51) Int. Cl.
*A63B 69/36* (2006.01)
*A63B 53/02* (2006.01)
*A63B 53/04* (2006.01)

(52) U.S. Cl.
USPC ..... 473/244; 473/246; 473/248; 473/288; 473/305; 473/307; 473/345; 473/349

(58) Field of Classification Search
CPC .. A63B 53/02; A63B 2053/027; A63B 53/06; A63B 53/16; A63B 2053/021; A63B 2053/022; A63B 2053/023; A63B 2053/025; A63B 2053/026; A63B 2053/028
USPC ..... 473/288, 244–248, 305–315, 345, 349
See application file for complete search history.

(56) References Cited

U.S. PATENT DOCUMENTS

| | | | | |
|---|---|---|---|---|
| 2,027,452 | A * | 1/1936 | Rusing | 473/246 |
| 2,067,556 | A * | 1/1937 | Wettlaufer | 473/308 |
| 5,039,098 | A * | 8/1991 | Pelz | 473/306 |
| 7,438,645 | B2 * | 10/2008 | Hsu | 473/246 |
| 7,476,160 | B2 * | 1/2009 | Hocknell et al. | 473/307 |
| 7,566,279 | B2 * | 7/2009 | Nakashima | 473/288 |
| 7,794,331 | B2 * | 9/2010 | Tsai et al. | 473/288 |
| 7,892,105 | B2 * | 2/2011 | Galloway | 473/288 |
| 7,963,855 | B2 * | 6/2011 | Sander et al. | 473/288 |
| 8,535,173 | B2 * | 9/2013 | Golden et al. | 473/307 |
| 8,574,092 | B2 * | 11/2013 | Galloway et al. | 473/244 |
| 8,641,554 | B1 * | 2/2014 | Hocknell et al. | 473/307 |
| 2005/0227779 | A1 * | 10/2005 | Lenhof et al. | 473/305 |
| 2009/0075749 | A1 * | 3/2009 | Cruz et al. | 473/306 |

* cited by examiner

*Primary Examiner* — Sebastiano Passaniti
(74) *Attorney, Agent, or Firm* — Rebecca Hanovice; Michael A. Catania; Sonia Lari

(57) ABSTRACT

An adjustable hosel assembly allows for adjustment of shaft angle and the distance between the shaft and the club head. The adjustable hosel assembly comprises a hosel portion, a cam piece, a bolt, and a golf club head having a convex or concave surface, wherein the hosel portion can move along the surface of the cam piece, and the cam piece can move along the surface of the club head, to adjust the orientation of a shaft placed within the hosel with respect to the club head, and wherein the bolt secures the cam piece and the hosel to the golf club head.

20 Claims, 6 Drawing Sheets

ADJUSTABLE GOLF CLUB HOSEL ASSEMBLY

CROSS REFERENCES TO RELATED APPLICATIONS

The present application claims priority to U.S. Provisional Patent Application No. 61/470,407, filed on Mar. 31, 2011, and to U.S. Provisional Patent Application No. 61/481,080, filed on Apr. 29, 2011, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having an adjustable hosel assembly. More specifically, the present invention relates to a golf club hosel connection assembly that allows a user to adjust the loft, lie, and face angle of the golf club head, thus providing the user with a range of shaft orientations such that the club can be adjusted to provide the user with better performance.

2. Description of the Related Art

Golfers benefit from alteration of the orientation of a shaft relative to the club head for drivers and other clubs. Changing the orientation of shaft insertion in the club body can mitigate a golfer's various faults or weaknesses. In fact, changing the angle of a golf club shaft with respect to the golf club head will change certain club specifications, including loft, lie, and face angle. Changing orientation of shaft insertion or shaft angle with respect to the golf club head can also change mass location.

Shaft insertion orientation typically is adjusted by bending a golf club hosel so that the shaft has a desired angle with respect to the club head. There are also several types of adjustable golf clubs that are available on the market, including models that employ annular wedges or near annular spacers inserted into the hosel bore to create a custom bore center. By choosing and installing particular versions of these annular wedge spacers, the centerline of the shaft is oriented favorably. A drawback to this approach, however, is that it provides a limited adjustment capacity and requires increased hosel volume to achieve necessary geometry and durability.

BRIEF SUMMARY OF THE INVENTION

The present invention relates to golf club heads that employ spherical interfaces between the shaft attachment portion or hosel and the head, thus enabling a broader range of settings. The present invention can be installed on top of the body of the head rather than inside the hosel of the club because of its conformal shape.

One aspect of the present invention is an adjustable hosel assembly for a golf club head, the adjustable hosel assembly comprising a hosel, a cam piece, and a bolt, wherein the cam piece sits on a surface of the golf club head and is movable along the surface of the golf club head, wherein the hosel sits on a surface of the cam piece and is movable along the surface of the cam piece, and wherein the bolt secures the cam piece and the hosel to the golf club head.

Another aspect of the present invention is an adjustable golf club assembly comprising a golf club head comprising a first surface, the first surface having a first bore, a cam piece comprising a second bore, a hosel comprising a third bore, and a bolt, wherein the cam piece is disposed on and movable along the first surface, wherein the hosel is disposed on and movable along the cam piece, and wherein the bolt extends through the first bore, the second bore, and the third bore to removably secure the cam piece and the hosel to the golf club head. The golf club head may comprise a face, a sole, and a crown, and the first surface may be located on the crown. The hosel may comprise a lower portion shaped to mate with the cam piece, and the first surface may be convex and the cam piece may be convex, or the first surface may be concave and the cam piece may be concave. The cam piece may comprise at least one marking, and the lower portion may also comprise at least one marking. In some embodiments, the cam piece may comprise at least one marking indicating a loft or lie angle, and the lower portion may comprise at least one marking indicating a loft or lie angle.

The adjustable golf club assembly may further comprise a lock ring and a spherical washer, wherein the lock ring comprises a fourth bore, wherein the spherical washer comprises a fifth bore, and wherein the bolt extends through the fourth bore and the fifth bore. The lock ring and the spherical washer may in some embodiments be disposed between the bolt and the hosel. The lower portion of the hosel may comprise at least one detent to inhibit movement of the lower portion along the cam piece, and the cam piece may further comprise at least one wall that abuts the detent.

Yet another aspect of the present invention is an adjustable driver comprising a body comprising a face, a sole, and a crown, the crown comprising a concave indent having a first bore, a concave cam piece sized to movably fit within the concave indent, the cam piece comprising a second bore, a hosel comprising a shaft receiving bore and a lower portion, the lower portion comprising a detent, a third bore, and a convex surface sized to movably mate with the concave cam piece, a washer comprising a fourth bore, and a bolt comprising a head and a threaded extension portion, the threaded extension portion sized to extend through each of the first, second, third, and fourth bores to removably affix the cam piece, hosel, and washer to the body, wherein the detent restricts the movement of the lower portion of the hosel along the cam piece, and wherein the first bore is threaded to receive the threaded extension portion. The shaft receiving bore may be disposed within a shaft holding portion, and the hosel may further comprise an extension portion connecting the shaft holding portion to the lower portion.

The adjustable driver may further comprise a lock ring disposed between the washer and the bolt, wherein the lock ring comprises a fifth bore. The crown may comprise at least one alignment marking proximate the concave indent, or the lower portion of the hosel may comprise a plurality of alignment markings, which may provide information regarding loft or lie angles. The body of the driver may be composed of more than one material. In some embodiments, the driver may further comprise a key assembly, wherein the key assembly comprises a crank, a cog having a first plurality of teeth, and an anchor, and wherein the cam piece comprises a second plurality of teeth sized to mate with the first plurality of teeth.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The invention utilizes a nested set of partial spherical shells or cams to provide hosel adjustability in golf club heads. These shells or cams include distributed detents such that the relative motion of the cams, and thus the hosels, can be stopped at a range of discrete orientations. In this application, the range of adjustment is small enough such that the orientation changes are on the order of rotations of a few degrees.

Figure 2:
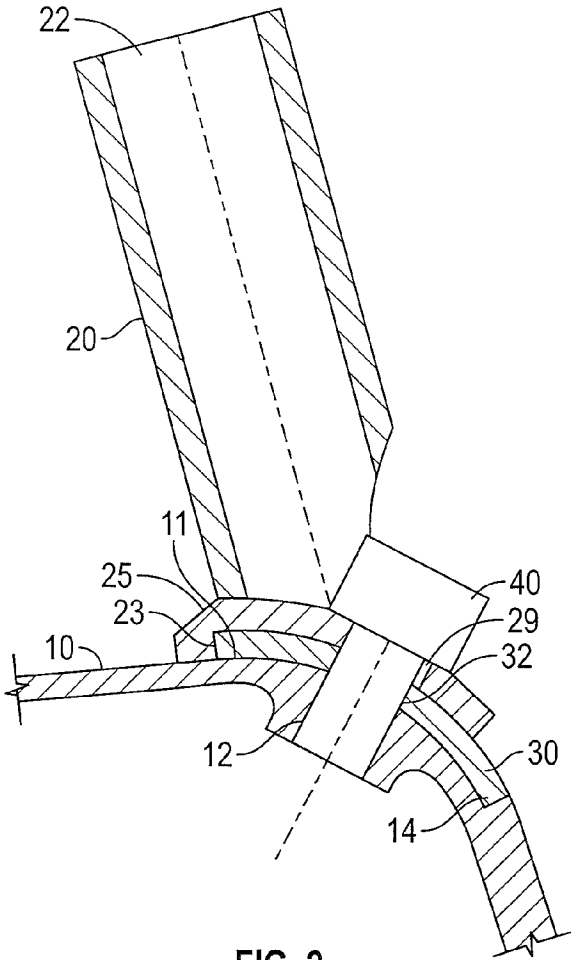
FIG. 2 is a cross-sectional view of the embodiment shown in FIG. 1 along lines 2-2.
Figure 1:
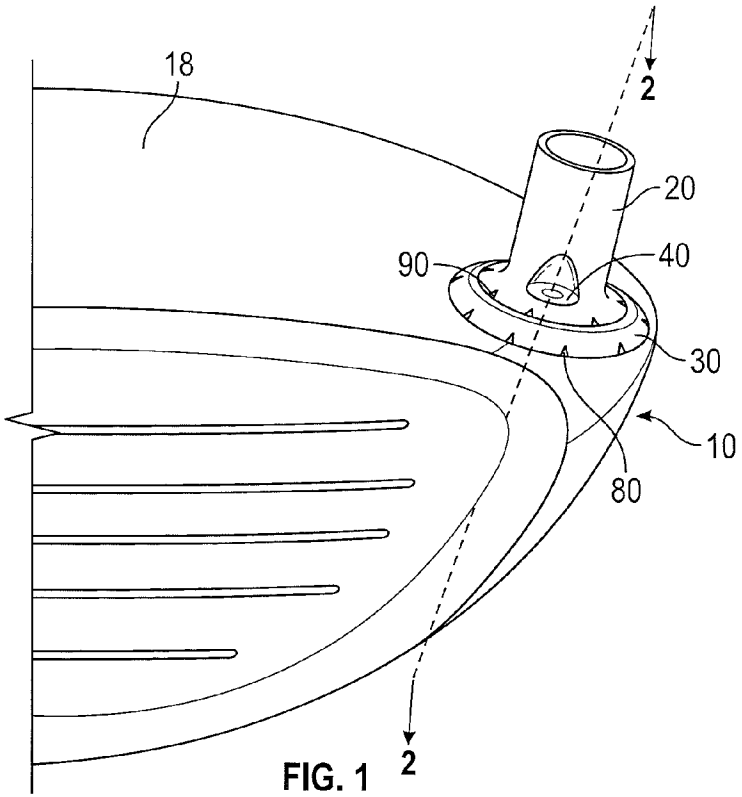
FIG. 1 is a front perspective view of a first embodiment of the present invention.

A first embodiment of the present invention is shown in FIGS. 1 and 2. The club head 10 of this embodiment is attached to a hosel 20 and an eccentric cam piece 30 via a bolt 40. The cam piece 30 is eccentric because it has non-consistent thickness, non-consistent curvature, or both. As shown in FIG. 2, the club head 10 has a convex surface 11 on which the cam piece 30, which in this embodiment is also convex, rests and around which the cam piece 30 moves during adjustment. A convex, lower portion 25 of the hosel 20 is shaped to fit over the cam piece 30, and can move along the surface of the cam piece 30 to adjust the angle of a shaft (not shown) secured within a bore 22 of the hosel 20. Detents 14, 23 prevent the pieces of this embodiment from moving too much relative to one another and allow a user to achieve discrete shaft orientations.

The lower portion 25, the cam piece 30, and the golf club head 10 each have bores 29, 32, 12 to receive the bolt 40, which holds each of these pieces together. The hosel 20 in this embodiment has a standard construction, but may have any construction known to a person of ordinary skill in the art, including the constructions shown in FIGS. 3-11. To adjust the angle of the hosel 20 with respect to the golf club head 10, the bolt 40 is loosened, the hosel 20 is adjusted by moving the lower portion 25 along the surface of the cam piece 30, or the cam piece 30 along the convex portion 11 of the club head 10, and then the bolt 40 is tightened to secure the hosel in place when the hosel 20 has a desired orientation. The hosel 20 and cam piece 30 can be moved by hand or with a tool, and each include markings 80, 90 that enable a golfer to make precise adjustments to the overall loft and lie of the golf club head 10. Once the hosel 20 is securely affixed to the golf club head 10 with the bolt 40, it is ready for use.

Figure 3:
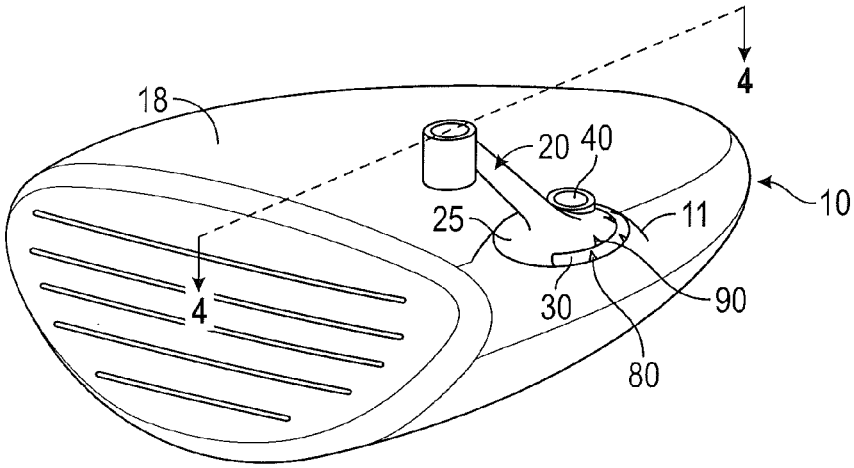
FIG. 3 is a side perspective view of a second embodiment of the present invention.
Figure 4:
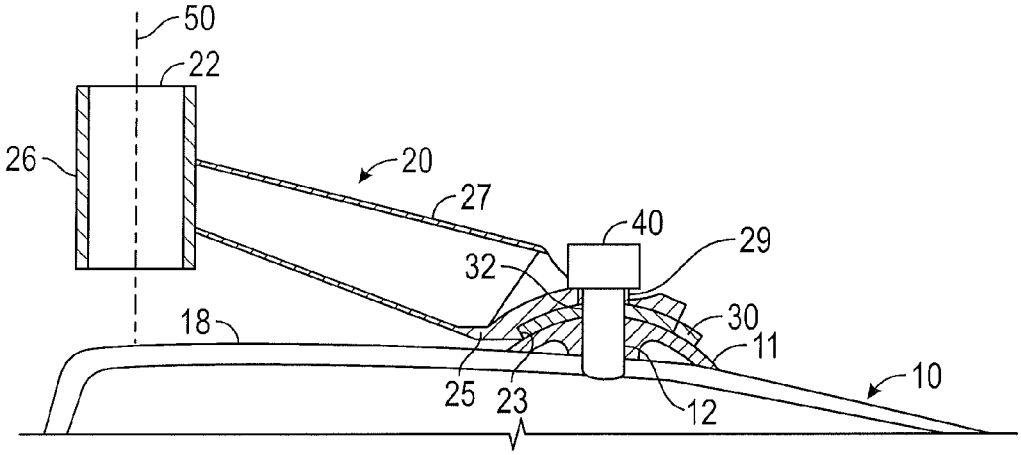
FIG. 4 is a cross-sectional view of the embodiment shown in FIG. 3 along lines 4-4.

A second embodiment of the present invention is shown in FIGS. 3 and 4. As in the first embodiment, the second embodiment includes a club head 10 affixed to a hosel 20 and an eccentric cam piece 30 via a bolt 40. The cam piece 30 is convex, as shown in FIG. 4, and is secured to a convex portion 11 of the golf club head 10. The hosel 20 in this embodiment includes an extension portion 27, a shaft holding portion 26 containing a hosel bore 22, and a convex, lower portion 25 shaped to fit over the cam piece 30. The lower portion 25 can move along the surface of the cam piece 30 to adjust the angle of a shaft (not shown) secured within a bore 22 of the hosel 20. Similarly, the cam piece 30 can be moved along the surface of the convex portion 11 of the golf club head 10 to adjust the shaft angle. When the hosel 20 has the position shown in FIG. 4, the hosel bore 22 has an axis 50 that is perpendicular to the top surface of the golf club head 10. The lower portion 25, the cam piece 30, and the golf club head 10 each have bores 29, 32, 12 to receive the bolt 40, which holds each of these pieces together.

To adjust the angle of the hosel 20 with respect to the golf club head 10, the bolt 40 is loosened, the hosel 20 is adjusted by moving the convex lower portion 25 along the surface of the cam piece 30, or the cam piece 30 along the convex portion 11 of the club head 10, and then the bolt 40 is tightened to secure the hosel in place when the hosel 20 has a desired orientation. At least one detent 23 prevents the pieces of this embodiment from moving too much relative to one another and allows a user to achieve discrete shaft orientations. The lower portion 25 of the hosel 20 and the cam 30 also include markings 80, 90 to aid a user in adjusting the overall loft and lie of the golf club head 10.

Figure 5:
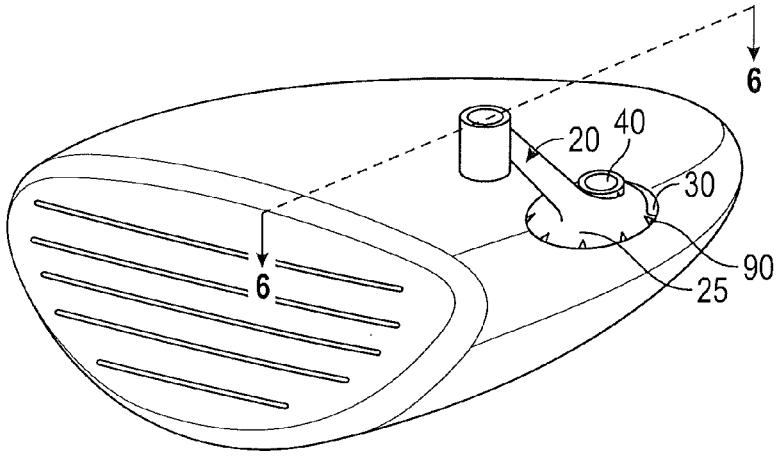
FIG. 5 is side perspective view of a third embodiment of the present invention.
Figure 6:
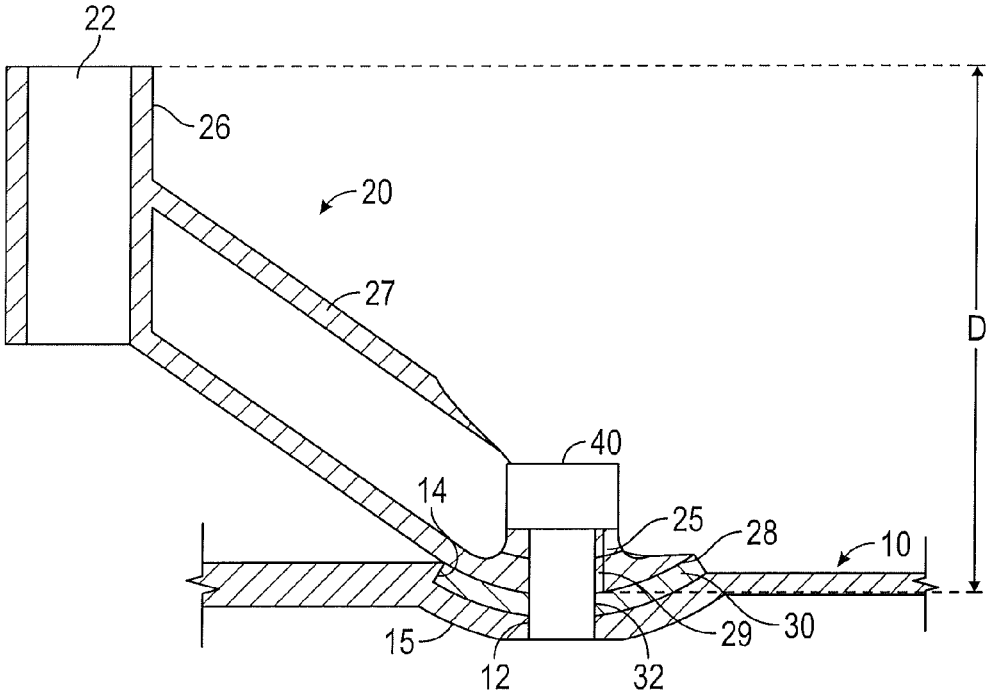
FIG. 6 is a cross-sectional view of the embodiment shown in FIG. 5 along lines 6-6.

A third embodiment of the present invention is shown in FIGS. 5 and 6. As in the first and second embodiments, the golf club head 10 of the third embodiment is affixed to a hosel 20 and an eccentric cam piece 30 via a bolt 40. In contrast with the embodiments shown in FIGS. 1-4, the club head 10 has a concave portion 15 sized to receive the cam piece 30, which is also concave and fits within the concave portion 15 of the head 10. The lower portion 25 of the hosel 20 also comprises a concave surface 28 that is sized to sit and move within the concave cam piece 30. The lower portion 25, the cam piece 30, and the golf club head 10 each have bores 29, 32, 12 to receive the bolt 40, which holds each of these pieces together.

As in the second embodiment, the hosel 20 of the third embodiment includes an extension portion 27 and a shaft holding portion 26 containing a hosel bore 22. When the hosel 20 has the configuration shown in FIG. 5, the distance D between the top surface of the shaft holding portion 26 and the surface of the golf club head 10 is approximately 1.49 inches. To adjust the angle of the hosel 20 with respect to the golf club head 10, as well as to adjust the distance D, the bolt 40 is loosened, the hosel 20 is adjusted by moving the lower portion 25 along the surface of the cam piece 30, or the cam piece 30 within the convex portion 15 of the club head 10, and then the bolt 40 is tightened to secure the hosel in place when the hosel 20 has a desired orientation. The hosel 20 and cam piece 30 may be moved by hand or with a tool. At least one detent 14 prevents the pieces of this embodiment from moving too much relative to one another and allows a user to achieve discrete shaft orientations. The lower portion 25 of the hosel 20, and visible portions of the cam piece 30, if any, can also include markings 80, 90 to aid a user in adjusting the overall loft and lie of the golf club head 10.

Figure 7:
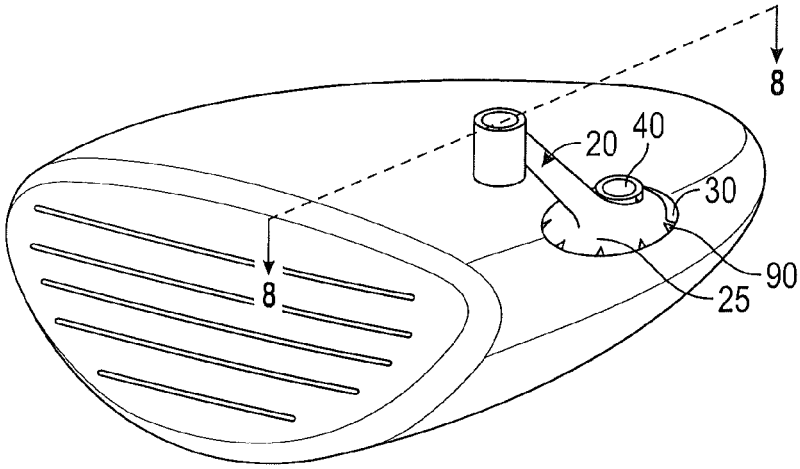
FIG. 7 is a side perspective view of a fourth embodiment of the present invention.
Figure 8:
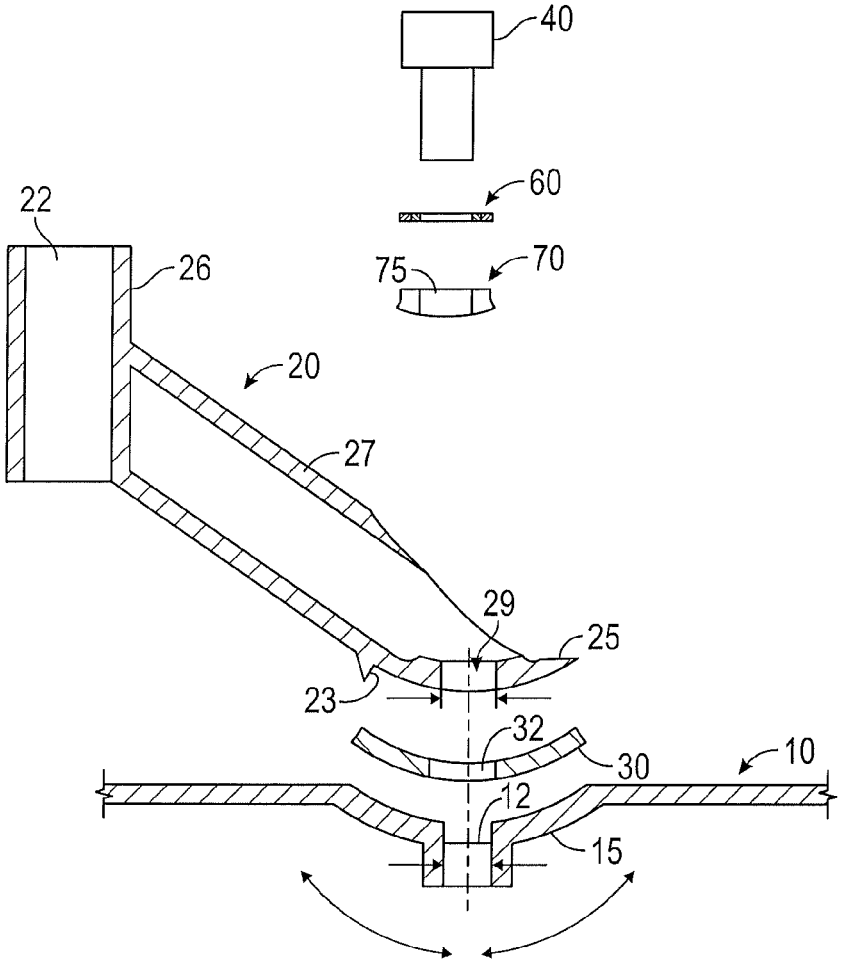
FIG. 8 is an exploded, cross sectional view of the embodiment shown in FIG. 7 along lines 8-8.

A fourth embodiment of the present invention is shown in FIGS. 7 and 8. This embodiment is similar to the third embodiment, as it includes a club head 10 that is attached to a hosel 20 and an eccentric cam piece 30 via a bolt 40, but it further includes a lock ring 60 and a spherical washer 70 having an oversized through hole 75. The club head 10 has a concave portion 15, the cam piece 30 is concave and fits within the concave portion 15 of the head 10, and a lower portion 25 of the hosel 20 includes a concave surface 28 that is sized to sit within the concave cam piece 30. The lower portion 25, the cam piece 30, and the golf club head 10 each have bores 29, 32, 12 to receive the bolt 40, which holds each of these pieces together. The bores may be coaxial, but preferably the center of the bore 32 of the cam piece 30 is slightly offset from the center of the bores 29, 12 of the hosel 20 or the club head 10. The bores preferably are between 0.15 and 0.25 inch in diameter, and more preferably approximately 0.18 or 0.19 inch in diameter.

To adjust the angle of the hosel 20 with respect to the golf club head 10, as well as to adjust the distance D, the bolt 40 is loosened, the hosel 20 is adjusted by moving the lower portion 25 along the surface of the cam piece 30, or the cam piece 30 within the convex portion 15 of the club head 10, and then the bolt 40 is tightened to secure the hosel in place when the hosel 20 has a desired orientation. At least one detent 23 prevents the pieces of this embodiment from moving too much relative to one another and allows a user to achieve discrete shaft orientations. The lower portion 25 of the hosel 20, and visible portions of the cam piece 30, if any, can also include markings 80, 90 to aid a user in adjusting the overall loft and lie of the golf club head 10.

Figure 9:
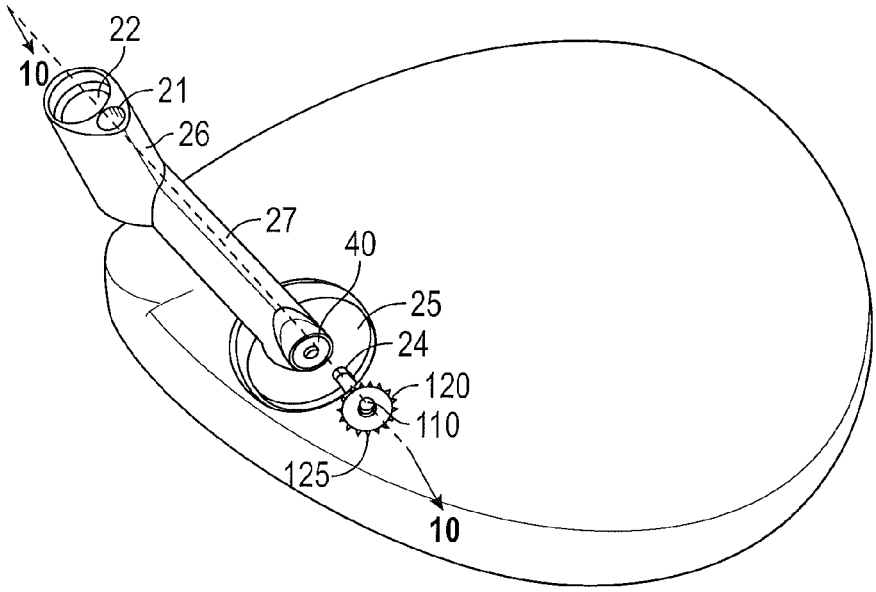
FIG. 9 is a rear perspective view of a fifth embodiment of the present invention.
Figure 10:
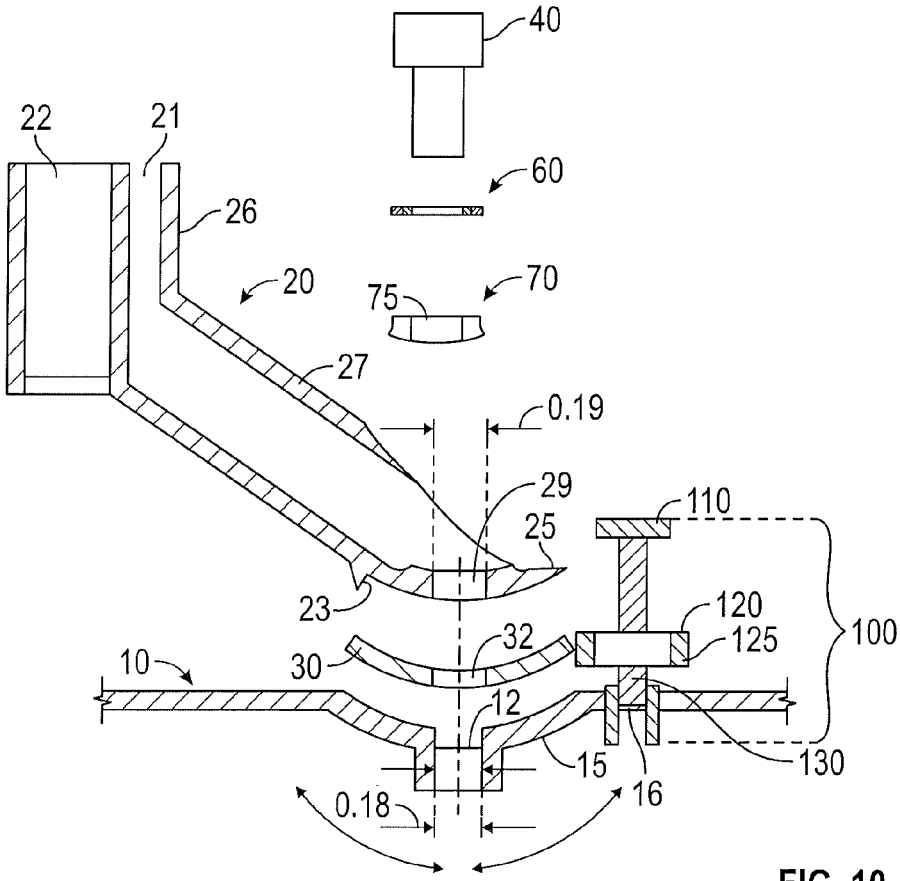
FIG. 10 is an exploded, cross-sectional view of the embodiment shown in FIG. 9 along lines 10-10.
Figure 11:
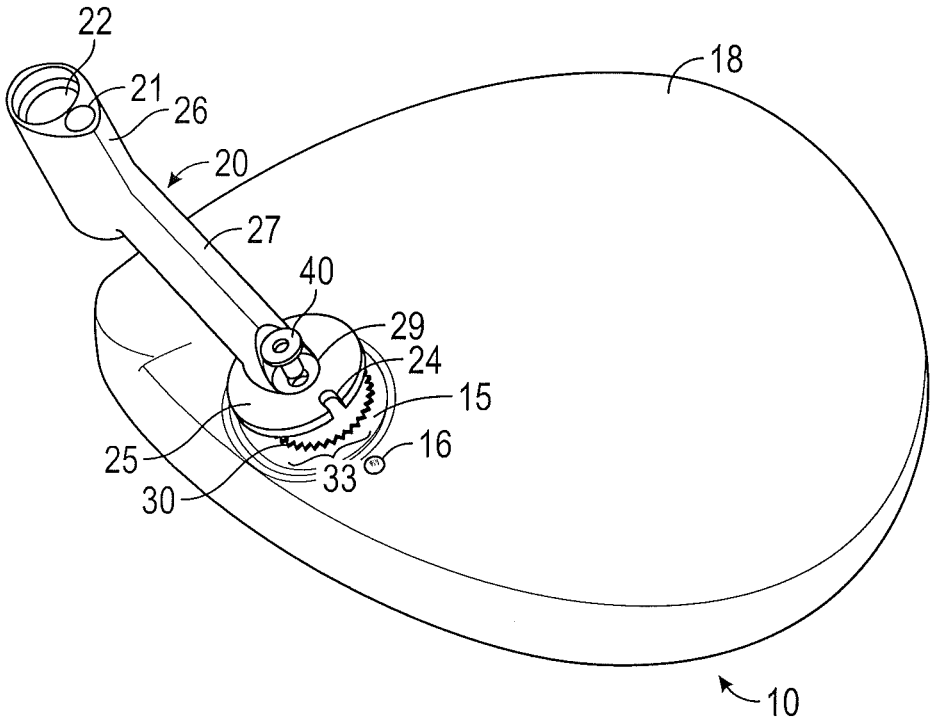
FIG. 11 is an exploded view of portions of the embodiment shown in FIG. 9.

A fifth, preferred embodiment of the present invention is shown in FIGS. 9-11. This embodiment is similar to the fourth embodiment, as it includes a club head 10, a hosel 20, an eccentric cam piece 30, a bolt 40, a lock ring 60 a spherical washer 70 having an oversized through hole 75, and several bores 12, 29, 32 all of which have similar or identical dimensions and/or characteristics. This embodiment preferably includes an alternative hosel 20 structure, which has two bores 21, 22 instead of just one. The larger bore 22 is designed to receive a lower end of a shaft (not shown), while the smaller bore 21 helps to reduce the overall hosel 20 weight. This hosel 20 structure can be used in connection with any of the embodiments disclosed and described herein. The fifth embodiment further differs from the fourth because the cam piece 30 has teeth 33, shown in FIG. 11, which interact with a key assembly 100, which is used to turn the cam piece 30 and thus adjust the hosel 20 angle with respect to the golf club head 10. The lower portion 25 of the hosel 20 also has a notch 24 into which one or more parts of the key assembly 100 can be inserted to access the teeth 33 of the cam piece 30.

FIGS. 9 and 10 show the key assembly 100, which comprises a crank 110, a cog 120 with teeth 125, and an anchor 130 that is inserted into an opening 16 in the crown 18 of the golf club head 10. The key assembly 100 allows a golfer to make more precise and accurate angular adjustments to the golf club hosel 20. To adjust the angle of the hosel 20 with respect to the golf club head 10 using the key assembly 100 (as well as to adjust the distance D), the bolt 40 is loosened such that the teeth 33 of the cam piece 30 are accessible and the anchor 130 is inserted into the opening 16. The teeth 125 of the cog 120 are engaged with the cam piece 30 teeth 33, and the crank 110 is turned so that the cog teeth 125 move the cam piece 30 teeth 33. This motion moves the eccentric cam piece 30 within the convex portion 15 of the club head 10, thus shifting the angle of the hosel 20 with respect to the golf club head 10, due at least to the non-consistent thickness and/or curvature of the cam piece 30. At least one detent 23 prevents the pieces of this embodiment from moving too much relative to one another and allows a user to achieve discrete shaft orientations.

Once a desired angle is achieved, the key assembly 100 is removed and the bolt 40 is tightened to secure the hosel 20 in place at its desired orientation. The notch 24 and the opening 16 may be covered with preformed inserts sort to prevent dirt and debris from becoming lodged within them during use of the golf club head 10. The inserts preferably are formed of an elastomeric material such as rubber, but may be constructed from any other type of material.

The golf club head 10 of each of the embodiments disclosed herein may include markings on one or more surfaces, but preferably the crown 18, in addition to any markings 80, 90 disposed on the hosel 20 and the cam piece 30, that can assist the golfer with adjustment.

The present invention provides golfers with the ability to easily and quickly modify club specifications such as loft, lie and face angle of their golf club, as well as mass location. This invention enables golfers to change these specifications at the practice range or golf course. The tools used to alter the club's specifications are minimal and can be carried in a pocket of the user's golf bag. The technical ability required to modify the club specifications with this invention is minimal and its approach is intuitive and easy to understand.

The present invention is also valuable because a golfer's swing may change over time, thus requiring alterations to his or her clubs. A golfer may improve his or her game through lessons and may gain greater flexibility and strength through practice and exercise. As such, it is reasonable for a golfer to wish to change his or her club's face, lie, and/or loft angles, and also mass location, to help improve his or her accuracy, distance, and feel as needed or desired. The embodiments of the present invention disclosed herein may be used in connection with any kind of golf club head, including woods, irons, and putters.

The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, and 8,012,041, the disclosure of each of which is incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. An adjustable golf club assembly comprising:

a golf club head comprising a first surface, the first surface having a first bore;

a cam piece comprising a second bore;

a hosel comprising a third bore; and a bolt, wherein the cam piece is disposed on and movable along the first surface;

wherein the hosel is disposed on and movable along the cam piece; and wherein the bolt extends through the first bore, the second bore, and the third bore to removably secure the cam piece and the hosel to the golf club head.

2. The adjustable golf club assembly of claim 1, wherein the golf club head comprises a face, a sole, and a crown, and wherein the first surface is located on the crown.

3. The adjustable golf club assembly of claim 1, wherein the hosel comprises a lower portion shaped to mate with the cam piece.

4. The adjustable golf club assembly of claim 3, wherein the first surface is convex and wherein the cam piece is convex.

5. The adjustable golf club assembly of claim 3, wherein the first surface is concave and wherein the cam piece is concave.

6. The adjustable golf club assembly of claim 3, wherein the lower portion comprises at least one marking.

7. The adjustable golf club assembly of claim 3, wherein the cam piece comprises at least one marking indicating a loft or lie angle, and wherein the lower portion comprises at least one marking indicating a loft or lie angle.

8. The adjustable golf club assembly of claim 3, wherein the lower portion comprises at least one detent to inhibit movement of the lower portion along the cam piece.

9. The adjustable golf club assembly of claim 8, wherein the cam piece comprises at least one wall that abuts the detent.

10. The adjustable golf club assembly of claim 1, wherein the cam piece comprises at least one marking.

11. The adjustable golf club assembly of claim 1, further comprising a lock ring and a spherical washer, wherein the lock ring comprises a fourth bore, wherein the spherical washer comprises a fifth bore, and wherein the bolt extends through the fourth bore and the fifth bore.

12. The adjustable golf club assembly of claim 11, wherein the lock ring and the spherical washer are disposed between the bolt and the hosel.

13. An adjustable driver comprising:

a body comprising a face, a sole, and a crown, the crown comprising a concave indent having a first bore;

a concave cam piece sized to movably fit within the concave indent, the cam piece comprising a second bore;

a hosel comprising a shaft receiving bore and a lower portion, the lower portion comprising a detent, a third bore, and a convex surface sized to movably mate with the concave cam piece;

a washer comprising a fourth bore; and a bolt comprising a head and a threaded extension portion, the threaded extension portion sized to extend through each of the first, second, third, and fourth bores to removably affix the cam piece, hosel, and washer to the body, wherein the detent restricts the movement of the lower portion of the hosel along the cam piece, and wherein the first bore is threaded to receive the threaded extension portion.

14. The adjustable driver of claim 13, wherein the shaft receiving bore is disposed within a shaft holding portion, and wherein the hosel further comprises an extension portion connecting the shaft holding portion to the lower portion.

15. The adjustable driver of claim 13, further comprising a lock ring disposed between the washer and the bolt, wherein the lock ring comprises a fifth bore.

16. The adjustable driver of claim 13, wherein the crown comprises at least one alignment marking proximate the concave indent.

17. The adjustable driver of claim 13, wherein the lower portion of the hosel comprises a plurality of alignment markings.

18. The adjustable driver of claim 17, wherein the plurality of alignment markings provide information regarding loft or lie angles.

19. The adjustable driver of claim 13, wherein the body is composed of more than one material.

20. The adjustable driver of claim 13, further comprising a key assembly, wherein the key assembly comprises a crank, a cog having a first plurality of teeth, and an anchor, and wherein the cam piece comprises a second plurality of teeth sized to mate with the first plurality of teeth.

* * * * *